US006086032A

United States Patent [19]

van Leeuwen

[11] Patent Number: 6,086,032

[45] Date of Patent: Jul. 11, 2000

[54] PURLIN CORNER HANGER HAVING A BODY TO CLEAR THE LOWER PROJECTING FLANGE OF A PURLIN

[75] Inventor: Martin van Leeuwen, Tilburg, Netherlands

[73] Assignee: Erico International Corporation, Solon, Ohio

[21] Appl. No.: 08/687,108

[22] Filed: Jul. 22, 1996

[51] Int. Cl.[7] ..... E04G 5/06; F16B 2/00; F16B 2/14; F16L 3/24

[52] U.S. Cl. ..... 248/228.1; 248/226.11; 248/72

[58] Field of Search ..... 248/228.1, 226.11, 248/72, 58, 59; 403/291, 228, DIG. 8; 52/506.5, 506.6, 698; 24/457, 716, 598.4

[56] References Cited

U.S. PATENT DOCUMENTS

| | | | |
|---|---|---|---|
| 508,280 | 11/1893 | Cavallaro | 248/228.1 X |
| 1,076,211 | 10/1913 | Korns | 248/72 |
| 1,134,395 | 4/1915 | Loepsinger | 248/72 |
| 1,646,288 | 10/1927 | Graham | 403/DIG. 8 X |
| 1,797,214 | 3/1931 | Mayer et al. | 248/72 X |
| 2,071,959 | 2/1937 | Wayman | 248/72 X |
| 2,163,635 | 6/1939 | Shea | 248/72 |
| 2,217,560 | 10/1940 | Michon | 403/DIG. 8 X |
| 2,504,086 | 4/1950 | Peters | 248/72 X |
| 2,544,096 | 3/1951 | Laughlin | 403/228 X |
| 2,661,969 | 12/1953 | Thiry | 403/228 |
| 2,736,527 | 2/1956 | Maier | 248/228.1 |
| 2,998,477 | 8/1961 | Hollander | 248/72 X |
| 3,874,035 | 4/1975 | Schuplin . | |
| 3,937,180 | 2/1976 | Wiggins | 118/635 |
| 4,046,184 | 9/1977 | Diehl | 152/407 |
| 4,133,085 | 1/1979 | Hansson | 52/208 |
| 4,399,941 | 8/1983 | Lubbers | 238/349 |
| 4,555,330 | 11/1985 | Tsutsumi et al. | 209/254 |
| 5,135,209 | 8/1992 | Penny | 269/249 |
| 5,181,683 | 1/1993 | Smith . | |
| 5,238,511 | 8/1993 | Gosling | 148/624 |
| 5,405,124 | 4/1995 | Mayer et al. | 269/45 |
| 5,577,854 | 11/1996 | Jacob et al. | 403/291 X |
| 5,680,680 | 10/1997 | LaConte | 24/295 |
| 5,740,994 | 4/1998 | Laughlin | 248/68.1 |
| 5,758,465 | 6/1998 | Logue | 52/506.06 |
| 5,769,758 | 6/1998 | Sarkinen | 482/44 |

FOREIGN PATENT DOCUMENTS

| | | | |
|---|---|---|---|
| 503239 | 8/1979 | Australia . | |
| 0319389 | 6/1989 | European Pat. Off. . | |
| 978822 | 4/1951 | France | 248/72 |
| 1552088 | 1/1969 | France . | |
| 94091587 | 7/1994 | Germany . | |
| 2007751 | 5/1979 | United Kingdom . | |
| 516104 | 12/1990 | United Kingdom . | |

OTHER PUBLICATIONS

European Patent Office, European Search Report for EP 96 11 1831 dated Dec. 20, 1996.

*Primary Examiner*—Daniel P. Stodola
*Assistant Examiner*—Gregory J. Strimbu
*Attorney, Agent, or Firm*—Renner, Otto, Boisselle & Sklar, LLP

[57] ABSTRACT

A purlin hanger used for suspending a wide variety of items from many different types of purlins which may be horizontal or sloping. The hanger is primarily a rigid high strength generally C-shape frame or body which includes an angled upper end and an offset lower end. The angled upper end bears against the interior of a corner formed by a web and a lower flange of the purlin. The lower end is slightly offset from the exterior of the corner and has a tapped hole to receive a threaded hanging rod to which a wide variety of clips or clamps may be attached. The C-shape frame extends with considerable clearance around the purlin lower flange and any treatment of the edge of the flange such a fold or further flange. An adjustable shim is positioned between the lower end of the body and the exterior of the corner of the purlin. The hanger engages the purlin at the interior of the corner and avoids placing a load with any significant moment arm on any part of the flange of the purlin.

21 Claims, 1 Drawing Sheet

PURLIN CORNER HANGER HAVING A BODY TO CLEAR THE LOWER PROJECTING FLANGE OF A PURLIN

DISCLOSURE

This invention relates generally as indicated to a purlin corner hanger, and more particularly to a universal purlin hanger which can be affixed to a wide variety of purlins without placing any significant load on the purlin lower flange.

BACKGROUND OF THE INVENTION

Purlins are struts or beams usually employed in roof decking for supporting the decking or common rafters. They are usually rolled in a variety of transverse or sectional shapes which can be described generally as C, Z, or S shape. A common feature is usually, however, a generally vertical web and usually top and bottom flanges. The flange edges may be subject to further treatment such a further flange or double flange with a flat or bulb fold. The purlins may extend horizontally or at an angle and vary significantly in dimension or gauge. For example, purlins may be from 100 to 300 mm high and have flange widths or extents of from 50 to 80 mm, with treated edges or lips which may be 10–20 mm high. The gauge or thickness may vary from about 1.5 to 3 mm.

It is often desirable to suspend a wide variety of items from purlins, such as piping, wiring conduit, ducts, fixtures or suspending ceilings, with up to about 100 kg static working load. Such items are most often suspended with threaded rod, and with other clips and clamps.

Items are hung from purlins in a number of different ways. One common way is to drill holes in purlins to accommodate fasteners to attach certain types of hangers. The process is labor intensive and requires additional tools (drills, wrenches, screw drivers, e.g.). Such attachments seldom permit adjustment, at least without additional holes, and sometimes drilling is forbidden, especially in lower flanges, which weakens the purlin section, not to mention any coating of the purlin.

Some clips or purlins clamps are available which engage either the lower or both flanges of the purlin. These clips or clamps, while effective, have reduced capacity, particularly with thin gauge purlins. Purlin flanges may be relatively fragile and are meant primarily to add strength and stiffness to purlin sections as a whole. Accordingly, any deformation of the flanges may put the stability of the whole purlin at risk as well as any attachments. It is desirable that the clip load not be at the very edge of the flange since the extent of the flange acts as a moment arm contributing to distortion.

Some clips try to distribute the load to both flanges. While this reduces the risk of deformation, the upper flange is not always accessible even if various heights, dimensions and configurations of flange pans can be met or accommodated. The industry has thus developed a number of hangers which are for specific types of purlins, rather than a universal hanger for many designs of purlins.

It would, therefore, be desirable to have a purlin hanger which did not require holes in the purlin; which did not place a load on the purlin flange, and particularly a load at the edge of the flange; and also which would fit a wide variety of types and sizes of purlins.

SUMMARY OF THE INVENTION

A purlin hanger is used for suspending a wide variety of items such as piping, wiring conduit, ducts, lighting, ceilings and the like, from many different types of purlins which may be horizontal or sloping. The hanger is primarily a rigid high strength generally C-shape frame or body which includes an angled upper end and an offset lower end. The angled upper end bears against the interior corner at the web and lower flange of the purlin. The lower end is slightly offset from the exterior of such corner and includes a tapped hole in a collar to receive a threaded hanging rod to which a wide variety of clips or clamps may be attached. In this manner the lower end projects beyond the upper end such that an axis of the tapped hole and collar will clear the upper end, and the lower end is offset from the upper end whereby a vertical line through the lower end will clear the exterior of the corner between the web and lower projecting flange. The body of the C-shape frame extends with considerable clearance around the purlin lower flange and any treatment of the edge of such flange such as a fold or further flange.

An adjustable shim may be positioned between the lower end of the body and the exterior of the web and lower flange corner of the purlin. The shim may be in the form of a plastic cap which is slipped on the lower end of the frame and which includes a vertical hole accommodating the threaded rod or other hanger extending through the tapped hole. The cap includes a rounded asymmetrical shoulder adapted to bear against the exterior corner at the web and flange of the purlin when the threaded rod is in place. Adjustment is obtained simply by turning the cap end-for-end about its axis. Such adjustment would be occasioned by a change in thickness or gauge of the purlin, or perhaps by an alteration of the external radius or configuration at such corner. The C-shape body or frame is preferably made as a cast or forged metal alloy, which may include a strengthening spine around the exterior. Alternatively, the frame may be made by transversely cutting an extrusion. It may also be made from steel sheet with pressed ribs for reinforcement. The hanger engages the purlin at the interior corner and avoids a load with any significant moment arm on any part of the flange of the purlin.

DETAILED DESCRIPTION OF THE PREFERRED EMBODIMENTS

Figure 1:
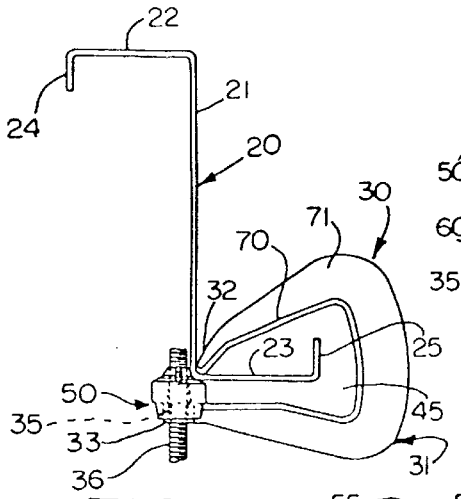
FIG. 1 is a transverse view of a purlin with a hanger in accordance with the present invention secured thereto.

Referring initially to FIG. 1, there is illustrated a purlin shown generally at 20 which comprises a vertical web 21, a top flange 22 and a bottom flange 23. Both flanges terminate in rebent short flange section edges as seen at 24 and 25, respectively.

What is illustrated is generally know as a Z-purlin. Some Z-purlins more closely resemble the letter Z with the web extending at a slight angle and the flanges directly above one another. If the flanges extend in the same direction, it is known as a C-purlin. Purlins come in a wide variety of shapes and such purlins may generally be described as C, Z, or S shape. For generally all such purlins, a common feature is the vertical web and the top and bottom flanges. Typically, a roof or rafters are supported on the top flange and the bottom flange or edge of the purlin is exposed. As indicated, purlins may extend horizontally or at an angle and may vary significantly in dimension or gauge.

The hanger of the present invention is illustrated generally at 30 and comprises a generally C-shape body or frame 31 which includes an upper end 32 and a lower end 33 which are fairly closely spaced to each other which makes the body an almost closed C-shape body. The gap should be enough to accommodate any edge treatment of the flange. The ends of the C-shape body are seen in FIGS. 1, 2, 5, 6 and 7. As seen more clearly in FIG. 6, the lower end 33 projects beyond the upper end 32 and terminates in what might be termed a circular collar 34 which includes a tapped hole 35 adapted to accommodate threaded rod 36. The lower leg of the frame or body extends generally horizontally as indicated at 38 but then extends downwardly as shown at 39 before extending upwardly to form the back of the C as indicated at 40 in FIG. 5. The top leg of the C-body extends downwardly at an angle as indicated at 42 and then terminates at an even sharper angle as seen at 43. The back of the C at 40 is slightly outwardly curved so that the body or frame has a relatively large interior 45 which completely clears the lower flange of the purlin and any edge treatment thereof such as shown at 25 in FIG. 1.

Figure 2:
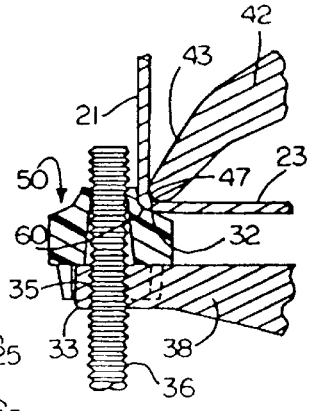
FIG. 2 is an enlarged sectional view of the engagement of the hanger and purlin.
Figure 4:
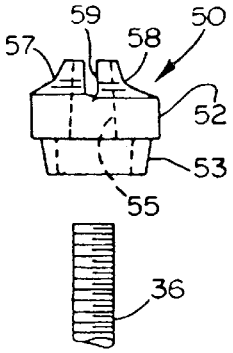
FIG. 4 is an exploded view of the threaded rod and shim.
Figure 3:
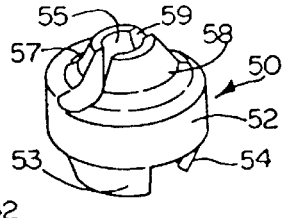
FIG. 3 is an enlarged perspective view of the adjustable shim which may be used with the hanger.

As can be seen more clearly in FIGS. 1, 2, 5 and 7, the upper end of the C of the body indicated at 32 is designed to engage the interior 47 of the corner between the web 21 and lower flange 23 of the purlin. For this purpose, the very tip of the C-shape body is rounded or radiused such that it will generally match the interior radius of the purlin. The lower end of the body extends beyond the web as seen in FIG. 2 so that the threaded rod 36 extends upwardly adjacent the web but on the opposite side as the upper leg of the body. As is apparent, the lower end of the body is offset from and projects beyond the upper end whereby the axis of or a vertical line through the threaded hole and collar will clear the exterior of the corner and the upper end of the body on the opposite side of the purlin.

In order to provide stability and tightness to the hanger, the hanger includes an adjustable shim shown generally at 50 in FIGS. 1–5 and 7. The adjustable shim has a generally circular main body 52 with two arcuate diametrically spaced and opposed depending skirt portions 53 and 54. A tapered normally unthreaded hole 55 extends upwardly through the circular body. The top of the circular body is provided with two concave somewhat conical sections or shoulders 57 and 58 which are separated by a diametrical slot 59. It is noted that the slot 59 extends perpendicular to the gap between the two depending skirt portions.

The hole 55 is such that when the threaded rod 36 projects upwardly through and just above the hole or the top of the shim as seen in FIGS. 1 and 2, the two concave upper portions of the shim are pushed apart and the radius formed by the concavity will snugly engage the exterior of the corner between the web 21 and flange 23 which is shown at 60 in FIG. 2.

The shim is adjustable in that the concave upper sides of the shim are asymmetrical about the axis. For example, the side on the right hand side of FIG. 4 may be somewhat thinner than the side on the left hand side and the right hand side is thus used for relatively thick purlins such as 2 to 3 mm. The thicker side on the left is used for relatively thinner purlins such as 1.5 to 2 mm. The adjustment is obtained simply by turning the cap or shim about its axis when it is inserted on the lower end of the C-body with the tapped hole end or collar 34 snapping between the skirts 53 and 54. When the threaded rod is in place, the upper end of the shim is distorted to press against the exterior of the corner of the purlin opposite the upper end of the C-body engaging the interior of the corner.

Figure 5:
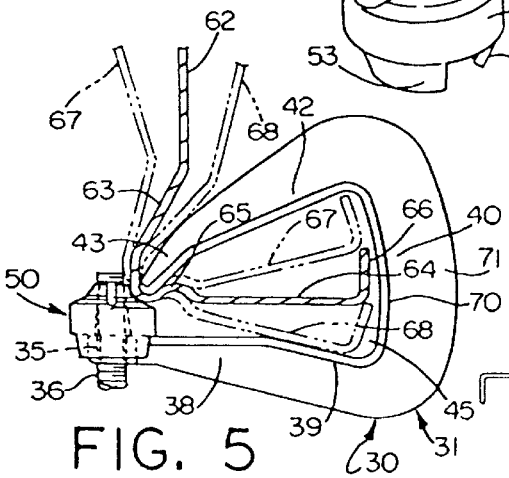
FIG. 5 is an enlarged view similar to FIG. 1 but illustrating clearances or angular variations of the purlin or hanger which may be accommodated by the hanger.

Referring now to FIG. 5, it will be seen that the purlin web 62 illustrated is not straight or vertical but includes an angled portion 63. Also the purlin flange 64 includes a ridge 65. The configuration of the upper portion of the C-body is such that the upper end of the body fits nonetheless in the interior corner and the opening 45 is sufficient to accommodate any edge treatment 66 of the flange at a number of swivel or pivot angles. For example, the purlin may be at the phantom line positions 67 or 68 which are approximately 15° on each side of the center position. In this manner, the angle of the rod may vary considerably with respect to the purlin orientation.

As seen in FIGS. 1, 5, 6 and 7, the C-shape body may be in radial section in the form of a variable stem T with the head 70 being an axial or transverse flange while the stem 71 acts as a spine. The radial extent of the spine varies, being least at the ends. The body of the C may be cast from a suitable alloy or forged. In addition to the above, it will be appreciate that the C-shape bodies in a more plain form may be formed by a metallic extrusion which is then simply transversely sliced to form the C-shape body before drilling and tapping the lower projecting end. A C-shape body such as shown may be made in this fashion. The body may also be made from steel sheet with pressed ribs for reinforcement. Also, two bodies side-by-side and connected to each other may be used.

Figure 7:
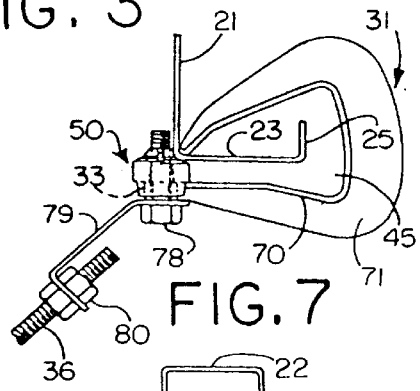
FIG. 7 is a view similar to FIG. 1 but showing the use of an intermediate rod hanger which may extend at an angle.
Figure 6:
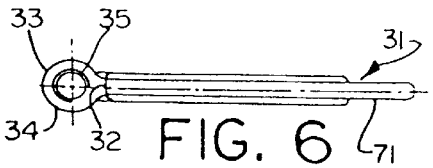
FIG. 6 is a top plan view of the hanger body or frame.

Referring now to FIG. 7, it will be seen that instead of the utilization of a threaded rod 36, a relatively short bolt 78 of the same size may be employed to secure to the underside of the hanger an accessory hanger 79. The hanger 79 may swivel at any angle around the axis of the bolt 78 and extend at substantially any acute angle to the portion of the accessory captured by the bolt. The threaded rod 36 is then secured to the accessory as indicated at 80. While the hanger itself may enable angular variations up to from about 15 to 20°, as indicated in FIG. 5, for larger angular variations, the accessory of FIG. 7 may be employed.

Figure 8:
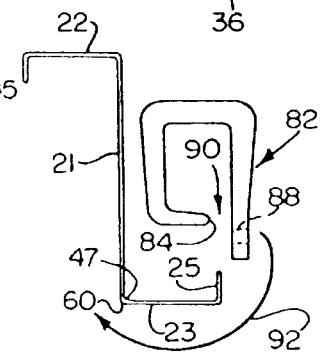
FIGS. 8 and 9 are views similar to FIG. 1 showing the installation and use of a simpler form hanger for use with relatively simple purlins and without a shim.
Figure 9:
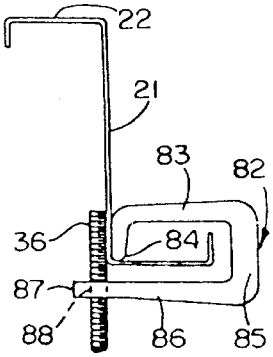

In FIGS. 8 and 9, there is illustrated a somewhat more simplified C-shape body and hanger system. The body 82 includes an upper arm 83 ending in a downwardly extending end or tip 84. The back 85 of the body is generally straight and the lower arm of the body 86 is generally parallel to the upper arm 83 and projects beyond the tip 84 as indicated at 87. The lower arm at the end is provided with a tapped hole 88 to accommodate threaded rod 36.

Like the embodiment of FIG. 1, there is a gap or space 90 between the tip of the upper end of the body and the lower end or leg. This gap is designed to accommodate any edge treatment of the lower flange 23 such as a bulb fold or rolled edge.

As seen in FIG. 8, the body may be installed by turning it up to permit the flange 25 to enter the gap 90 and then simply turning the body in the direction of the arrow 92 to achieve the position seen in FIG. 9. When the threaded rod is inserted as seen in FIG. 9, it will extend upwardly a somewhat greater extent and the side of the rod will abut the web of the purlin from the exterior corner to approximately the same height as the body on the opposite side of the web.

Figure 10:
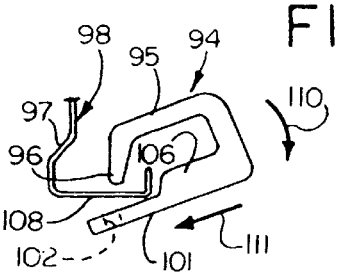
FIGS. 10 and 11 are views like FIGS. 8 and 9 but with the hanger modified for a different form purlin and having a contact area beneath the purlin flange.
Figure 11:
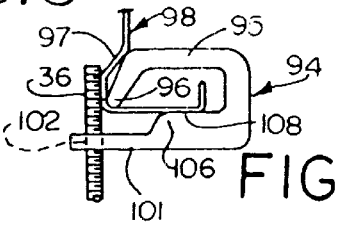

In FIGS. 10 and 11, there is illustrated a hanger with a somewhat modified C-shape body 94. The top leg 95 has an angled nose 96 to duck under or clear the angled web 97 of purlin 98. The lower horizontal leg 101 includes the jutting tapped hole 102 for threaded rod 36 and has an interior enlarged or thickened portion 106 adapted to contact the underside of the lower flange 108 of the purlin 98. The contact area of the enlargement assures a form lock when the hanger is assembled simply by installing as in FIG. 10 by rotating in the direction of the arrows 110 and 111, and then inserting the threaded rod 36 to an elevation adjacent the exterior of the web at the corner, as illustrated. As in the simplified forms of FIGS. 8–11, the form lock is assured even though the rod cannot pivot.

It can now be seen that there is provided a hanger which engages the purlin at the bottom end of the web and which clears the lower flange of the purlin and avoids putting any force on the lower flange through any significant moment arm which might cause distortion of that flange. It will also be seen that the hanger of the present invention fits a wide variety of purlins and may be quickly secured to the purlin, whether that purlin be horizontal or at an angle. The adjustable shim accommodates a variety of purlins which vary in thickness.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. In combination a purlin hanger and a purlin, said purlin including a web and a lower projecting flange, said web and said flange forming a corner with an interior and an exterior, said hanger including an almost C-shaped body having an upper end and a lower end relatively closely spaced with respect to each other, the upper end of the body nesting in the interior of the corner, the lower end of the body being positioned adjacent the exterior of the corner, and means for hanging an object from the lower end of the body, the body clearing the flange so that no significant moment is applied to the purlin.

2. A combination as set forth in claim 1 wherein the lower end of the body includes a tapped hole to receive a threaded rod.

3. A combination as set forth in claim 1 including a shim on the lower end of said body, said shim bearing against the exterior of the corner.

4. A combination as set forth in claim 1 including a plastic cap on the lower end of said body wedged between the body and the exterior of the corner.

5. A combination as set forth in claim 1 wherein the lower end of the body is offset from the upper end of the body such that a vertical line through the lower end clears the exterior of the corner.

6. A combination as set forth in claim 1 including an adjustable shim on the lower end of the body, the shim being adjusted by rotating said shim about a generally vertical axis.

7. A combination as set forth in claim 1 including form locking means which engage the purlin to maintain the body in a fixed position with respect to the purlin.

8. A combination as set forth in claim 7 wherein said form locking means engages the exterior of the corner of the purlin.

9. A combination as set forth in claim 1 including an adjustable shim on the lower end of the body, and means for adjusting a position of the shim with respect to the body.

10. A combination as set forth in claim 1 wherein the body is one of a metal casting and a forging.

11. A combination as set forth in claim 1 wherein the body is formed of sheet steel.

12. A combination as set forth in claim 1 wherein the upper end of the body is radiused to fit the interior of the corner.

13. A combination as set forth in claim 1 wherein the body is a transverse slice of a metallic extrusion.

14. A combination as set forth in claim 1 wherein an interior of the body is shaped to clear the flange and a treatment of an edge of the flange.

15. A combination as set forth in claim 1 wherein an interior of the body is large enough to enable the body to pivot with respect to the purlin.

16. A combination as set forth in claim 1 wherein the upper end of the body extends upwardly and outwardly from the interior of the corner and between the web and the flange.

17. A combination as set forth in claim 1 wherein the lower end of the body is formed by a leg having an enlargement which engages an underside of the flange.

18. A purlin hanger comprising an almost closed C-shape body having an upper end, a lower end, and a back connecting the ends, the upper end having a rounded tip and the lower end having a collar with a threaded hole vertically offset from the upper end, said lower end projects horizontally beyond said upper end such that an axis of the threaded hole and collar will clear said upper end, wherein the rounded tip and the collar are relatively closely spaced, and the upper end and the lower end are spaced increasingly farther apart at increasing distance from the rounded tip and the collar with the threaded hole.

19. A hanger as set forth in claim 18 wherein the back is outwardly curved.

20. A hanger as set forth in claim 18, further comprising a shim on the lower end, the shim having a concave shoulder proximate the rounded tip for gripping a purlin between the shoulder and the tip.

21. A hanger as set forth in claim 20 wherein the shim is adjustable and can be adjusted by turning said shim about an axis of said shim.

* * * * *